United States Patent [19]

DeHaan

[11] 3,984,222

[45] Oct. 5, 1976

[54] DEWAR COOLING DEVICE

[75] Inventor: James R. DeHaan, Boulder, Colo.

[73] Assignee: Cryogenic Technology, Inc., Denver, Colo.

[22] Filed: Dec. 23, 1974

[21] Appl. No.: 535,356

[52] U.S. Cl. ..... 62/54; 165/179; 165/181; 220/9 LG; 220/14

[51] Int. Cl.[2] ..... F17C 7/02

[58] Field of Search ..... 62/45, 55, 54, 514; 220/9 LG, 14; 165/179, 181

[56] References Cited

UNITED STATES PATENTS

| | | | |
|---|---|---|---|
| 3,108,447 | 10/1963 | Maher et al. | 62/54 |
| 3,538,714 | 11/1970 | Kling et al. | 62/54 |
| 3,705,498 | 12/1972 | DeHaan | 62/54 |

*Primary Examiner*—William F. O'Dea
*Assistant Examiner*—Ronald C. Capossela
*Attorney, Agent, or Firm*—Griffin, Branigan and Butler

[57] ABSTRACT

A dewar vessel adapted to have fluid pumped therefrom to reduce its internal pressure and temperature has a porous plate located in the path of the pumped fluid. For a given fluid pressure and viscosity, the pores are sized to provide a sufficiently low pressure drop across the plate while still providing a sufficiently large surface area for the transfer of heat between the vessel and the pumped fluid. A sheet-like liquid-retaining collar extends from the interior wall of the dewar container toward the center thereof so that the container liquid is restrained from moving along the container's inner wall when the container is tilted.

16 Claims, 6 Drawing Figures

DEWAR COOLING DEVICE

BACKGROUND AND SUMMARY

Frequently items such as electrical instruments are refrigerated by immersion in cryogenic fluids. In such cases it is customary to mount the instrument on a probe which extends into a dewar vessel so that the instrument is located at the bottom of the vessel. The vessel is then filled with a cryogen which is used for refrigeration as it boils off. When the cryogen has boiled off to the point where it no longer covers the instrument, however, the vessel must be refilled in order to provide more refrigeration and still cover the instrument. When the instrument is used in the field, as is often the case, this usually requires that the vessel be removed from use and transported to a convenient filling location. Hence, a need has arisen for an improved dewar vessel for making better use of the contained cryogen and lengthening its "holding time" — the time during which a vessel of a given size can be used without requiring refilling.

One method of conserving the refrigeration value of a dewar is to increase the thermal conductivity of a selected portion of the dewar's neck tube. One such method, for example, is described in my U.S. Pat. No. 3,705,498. In that patent, the vessel's boil-off gases are directed through a relatively lengthy restricted area of the vessel's exhaust conduit. This increases the velocity of the boil-off gases so that their refrigeration value is more readily passed to a surrounding high-thermal-conductivity collar. In some cases, however, it is desireable to reduce the vessel's temperature below that of its cryogen's normal boiling point. This is usually accomplished by pumping on the cryogen to reduce its pressure and, therefore, its boiling point. In such cases the structure of U.S. Pat. No. 3,705,498 is not entirely satisfactory. Among other reasons this is because the restriction means reduces the cross-sectional area to less than that which is desired to maintain an adequate pumping flow. Hence, the desired lower pressures and temperatures are difficult to achieve. In one of the preferred embodiments about to be described, however, these drawbacks are overcome by arranging one or more porous plates across the vessel's exhaust conduit. These plates do not hinder pumping flow but nevertheless capture the refrigeration from the vessel's boil-off gases and use it to intercept the heat that would otherwise tend to enter the vessel.

Often, such as in the case of Maser dewars for example, the vessels are tipped to an angle of 45° or so with the horizontal so that a quantity of the vessel's cryogen is tipped away from the refrigerated instrument; and, therefore, not available to cover it. Hence, the vessel must be refilled while much of its cryogen remains unused. A preferred embodiment about to be described, however, includes structure for further extending the dewar's holding time when it is used to refrigerate an instrument housed in a vessel that is inclined with the horizontal. This is accomplished by providing a sheet-like retaining collar that extends from the vessel's interior wall toward the instrument so that the collar prevents the cryogen from moving up the interior wall when the vessel is tilted. In this manner a lesser amount of cryogen is required to cover the instrument so that it does not have to be refilled so often.

BRIEF DESCRIPTION OF THE DRAWINGS

The foregoing and other objects, features, and advantages of the invention and preferred embodiments thereof are illustrated in the accompanying drawings, wherein the same reference numerals refer to the same parts throughout the various views. The drawings are not necessarily intended to be to scale, but rather are presented so as to illustrate the principles of the invention in clear form.

DESCRIPTION OF PREFERRED EMBODIMENTS

Figure 1:
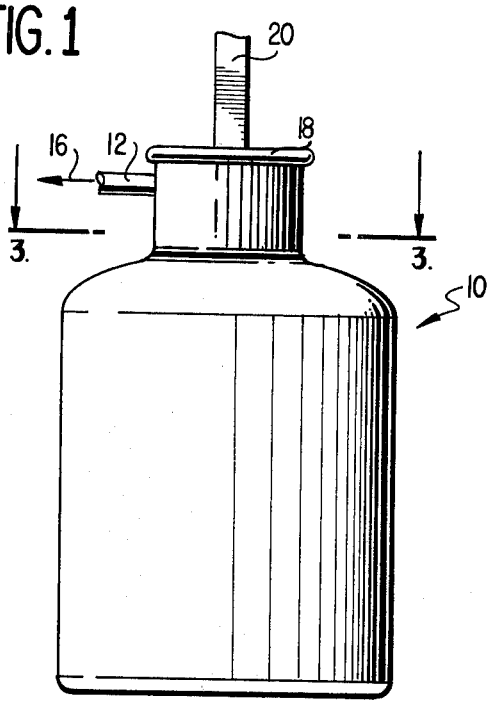
FIG. 1 is a pictorial view of a dewar vessel for refrigerating a microwave detector on the end of a waveguide.

In FIG. 1 a conventional dewar vessel 10 has a pump-out tube 12 attached to neck 14 thereof so that boil-off gases can be pumped out of the vessel's interior, as illustrated by arrow 16, in order to reduce the vessel's interior pressure and temperature. The vessel is covered by a cap 18 through which a wave guide 20 extends upwardly toward electronic equipment (not shown).

Figure 2:
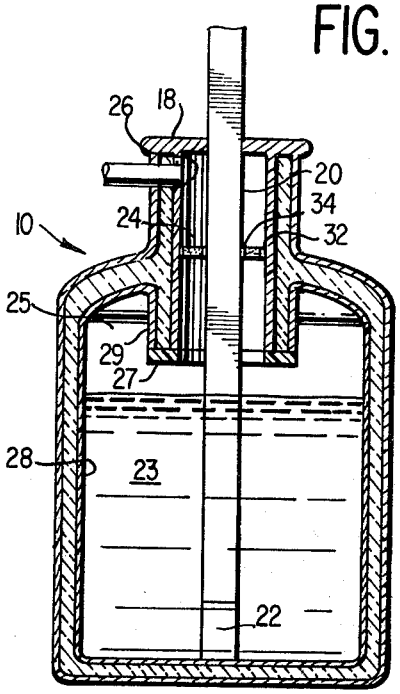
FIG. 2 is a vertical sectional view of the structure illustrated in FIG. 1.
Figure 3:
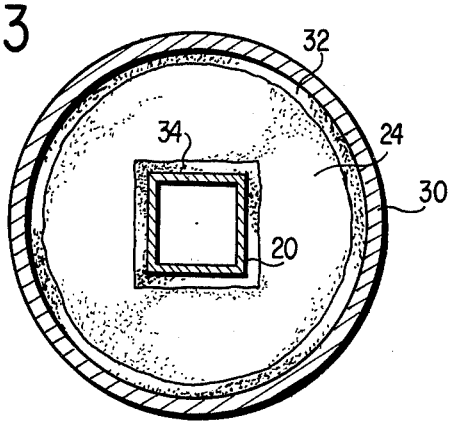
FIG. 3 is a sectional view taken along the lines 3—3 in FIG. 1.

The wave guide 20 extends downwardly into the vessel's interior as shown in FIG. 2. In the illustrated embodiment a microwave detector element 22 is located on the waveguide at the bottom portion of the vessel and is covered by a cryogen 23 such as liquid helium. The upper portion of the wave guide 20 in FIG. 2 passes through a porous plate 24 which is illustrated in more detail in FIG. 3. In this regard, the porous plate 24 is of a conventional sintered powder type to provide a structure having both large pores and a large surface area.

In the above manner, the boil-off gases from the cryogen 23 have their refrigeration captured by the large surfaces of the plate 24 without affecting the pumping speed therethrough so that the desired low pressure can be achieved in the vessel's ullage volume 25. Only one plate 24 is illustrated, but it will be appreciated that more can be used or the pore sizes changed so long as there is adequate flow area to provide a sufficiently low pressure drop, and adequate surface area to provide the desired contact for heat exchange. In this respect the pore size and number of plates depend upon such factors as the pressure and viscosity of the fluid. Hence, they are different for different applications.

The porous plate 24 is illustrated as being maintained in close thermal contact with the inner portion 26 of a reentry neck. That is, a neck comprised of the inner tube 26 which extends from the area of the cap 18 downwardly to a low-thermal-conductivity ring 27 which is connected to the vessel's inner wall by an outer tube 29. In this manner the reentry neck has a much longer "thermal length" than is evident from the vessel's exterior.

The actual contact between the porous plate 24 and the tube 26 is by means of a ring 32 of a high thermal-conductivity compressible wire mesh which serves to transfer heat from the neck tube portion 26 to the porous plate 24. This compressible mesh 32 also serves as a slideable seal between the neck tube wall 26 and the porous plate to prevent the flow of boil-off gases from passing out of the vessel without contacting either the porous plate 24 or the mesh itself. Similarly, a rectangular piece of compressible wire mesh 34 is located between the porous plate 24 and the wave guide 20 to perform a similar function to that of the compressible wire mesh 32. That is, mesh 34 transfers heat that tends to travel down the wave guide 20 to the porous plate 24 and prevents boil-off gases from escaping without giving up their refrigeration.

Figure 4:
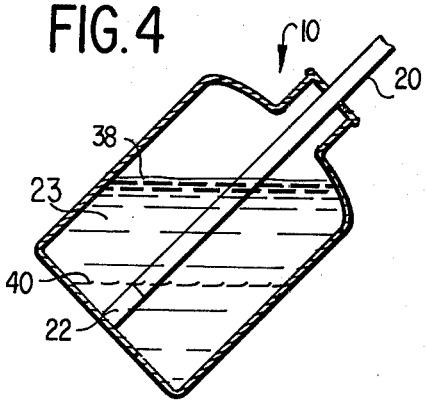
FIG. 4 is a schematic illustration of the cryogen in a prior-art vessel that is operated in a tilted position.

As indicated above, Maser dewars are frequently used in radio-astronomy devices or the like which scan the horizon at angles of as much as 45°. In such cases, the vessel's cryogen 23 maintains its horizontal position as illustrated by line 38 in FIG. 4 while the vessel 10, wave guide 20, and microwave detector 22 are tilted. When the cryogen boils off so that its level reaches that illustrated by line 40, however, the vessel must be refilled so that the detector 22 is not left uncovered. In this regard, the structure illustrated in FIG. 5 reduces the amount of cryogen that is required to cover the instrument 22 when the vessel is in its tilted position.

Figure 5:
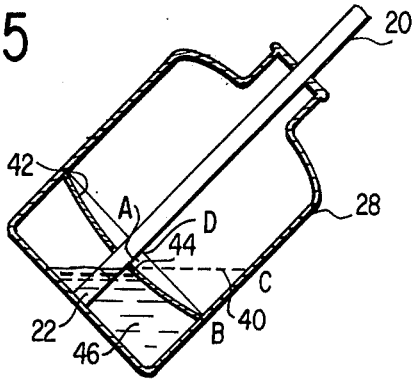
FIG. 5 is a schematic illustration of the cryogen level in a preferred embodiment of structure according to the instant invention.
Figure 6:
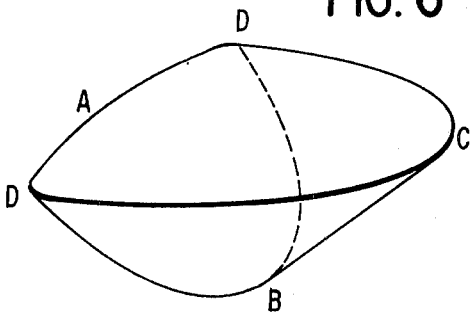
FIG. 6 is a schematic illustration of the additional volume of cryogen that is available for use with the FIG. 5 embodiment.

The structure illustrated in FIG. 5 includes a generally sheet-like element 42 which extends outwardly from the instrument's probe (in this case wave guide 20) in a collar-like manner. The inner portion 44 of the member 42 is shaped to accommodate the probe 20 and depressed, as shown, to provide a funnel-shaped section having a hole therein for the entry of a cryogen such as liquid helium into the lowermost portion 46 of the vessel 10. The perimeter of member 42 is sealed to the inner wall 28 of the container 10. In this manner, a volume ABCD in FIGS. 5 and 6 remains available for boil-off to increase the vessel's holding time before it has to be refilled.

While the invention has been particularly shown and described with reference to preferred embodiments thereof, it should be noted that various changes in form and detail may be made therein without departing from the spirit and scope of the invention. For example, although only one plate 24 has been illustrated in the embodiment of FIG. 2, other porous plates can be added to increase the amount of boil-off refrigeration that is captured so long as they do not appreciably diminish the vessel's pump-out ability. Similarly, although the collar-element 42 is illustrated as being directed conically downwardly, it could also be flat or shaped differently and still provide the above described advantages.

The embodiments of the invention in which an exclusive property or privilege is claimed are defined as follows:

1. A cryogenic storage vessel of the Dewar type in which an inner storage container thereof is adapted to be pumped to remove fluid therefrom to reduce the pressure in said inner storage container as pumped fluid is removed, said storage vessel comprising:

refrigeration capturing means for capturing refrigeration from the pumped fluid including a highly thermally conductive porous member located in the path of the fluid being pumped therefrom so that the refrigeration from said fluid is transferred to said highly thermally, conductive porous member;

said refrigeration capturing means being in contact with the wall of said inner storage container so that refrigeration is transferred thereto and available to intercept heat entering said inner storage container along said wall;

said highly thermally conductive porous member having pores sized so that a given pumping speed can be maintained, but having a surface area sized so that a given amount of refrigeration from the pumped fluid can be transferred thereto; and wherein said refrigeration capturing means includes a highly thermally conductive compressible member between said inner wall and said highly thermally conductive porous member for substantially sealing the volume between said wall and said porous member to prevent the flow of fluid between said porous member and said wall.

2. The vessel of claim 1 wherein said highly thermally conductive compressible member is comprised of a wire mesh.

3. A cryogenic storage vessel of the Dewar type in which an inner storage container thereof is adapted to be pumped to remove fluid therefrom to reduce the pressure in said inner storage container as pumped fluid is removed, said storage vessel comprising:

refrigeration capturing means for capturing refrigeration from the pumped fluid including a highly thermally conductive porous member located in the path of the fluid being pumped therefrom so that the refrigeration from said fluid is transferred to said highly thermally conductive porous member;

said refrigeration capturing means being in contact with the wall of said inner storage container so that refrigeration is transferred thereto and available to intercept heat entering said inner storage container along said wall;

said highly thermally conductive porous member having pores sized so that a given pumping speed can be maintained, but having a surface area sized so that a given amount of refrigeration from the pumped fluid can be transferred thereto;

probe means extending through said refrigeration capturing means into said inner storage container;

said refrigeration capturing means being in contact with said probe means so that said refrigeration is available to intercept heat entering said inner container along said probe means; and a sheet-like fluid retaining means located in the lower portion of said inner storage container and extending from the inner walls thereof toward said probe for preventing a portion of the cryogen in said vessel from moving past said retaining means when said vessel is tilted.

4. The vessel of claim 3 wherein said retaining means has a generally conical shape, the larger circumferential portion thereof being in contact with the inner wall of said storage container; and the smaller circumferential portion thereof surrounding said probe.

5. A cryogenic storage vessel of the Dewar type in which an inner storage container thereof is adapted to be pumped to remove fluid therefrom to reduce the pressure in said inner storage container as pumped fluid is removed, said storage vessel comprising:

refrigeration capturing means for capturing refrigeration from the pumped fluid including a highly thermally conductive porous member located in the path of the fluid being pumped therefrom so that the refrigeration from said fluid is transferred to said highly thermally conductive porous member;

said refrigeration capturing means being in contact with the wall of said inner storage container so that refrigeration is transferred thereto and available to intercept heat entering said inner storage container along said wall;

said highly thermally conductive porous member having pores sized so that a given pumping speed can be maintained, but having a surface area sized so that a given amount of refrigeration from the pumped fluid can be transferred thereto; and a reentry neck between said wall of said inner storage container and the outer wall of said vessel.

6. A cryogenic storage vessel of the Dewar type in which an inner storage container thereof is adapted to be pumped to remove gas therefrom through a neck portion thereof to reduce the pressure in said inner storage container as pumped gas is removed through said neck portion, said storage vessel comprising:

refrigeration capturing means for capturing refrigeration from the pumped gas including a highly-thermally-conductive sintered porous plate located in the path of the gas being pumped therefrom so that the refrigeration from said gas is transferred to said sintered porous plate;

said refrigeration capturing means being in contact with the wall of said neck portion of said inner storage container and extending over the area of said neck portion available for gas flow so that refrigeration is transferred thereto and available to intercept heat entering said inner container along said wall;

said highly-thermally-conductive sintered porous plate having pores sized so that a given pumping speed can be maintained, but having a surface area sized so that a given amount of refrigeration can be transferred thereto from the pumped gas.

7. The vessel of claim 6 including probe means extending through said refrigeration capturing means into said inner storage container;

said refrigeration capturing means being in contact with said probe means so that said refrigeration is available to intercept heat entering said inner container along said probe means.

8. The vessel of claim 7 including a highly thermally conductive compressible member between said probe means and said highly thermally conductive sintered porous plate for transferring heat between said probe means and said sintered porous plate.

9. The vessel of claim 8 wherein said highly thermally conductive compressible member is a wire mesh.

10. The vessel of claim 7 including a second highly thermally conductive compressible member between said inner wall and said highly thermally conductive sintered porous plate for transferring heat between said sintered porous plate and said wall.

11. The vessel of claim 10 wherein the first and second highly thermally conductive compressible members are comprised of a wire mesh.

12. The vessel of claim 7 including a sheet-like fluid retaining means located in the lower portion of said inner storage container and extending from the inner wall thereof toward said probe for preventing a portion of the cryogen in said vessel from moving past said retaining means when said vessel is tilted.

13. The vessel of claim 12 wherein said retaining means has a generally conical shape, the larger circumferential portion thereof being in contact with the inner wall of said storage container; and, and smaller circumferential portion thereof surrounding said probe.

14. The vessel of claim 6 wherein said refrigeration capturing means includes a highly-thermally-conductive compressible member between said inner wall and said highly-thermally-conductive sintered porous plate for substantially sealing the volume between said wall and said sintered porous plate to prevent the flow of fluid between said sintered porous plate and said wall.

15. The vessel of claim 14 wherein said highly-thermally-conductive compressible member is comprised of a wire mesh.

16. The vesel of claim 6 wherein said neck portion is of the reentry-type and extends between said wall of said inner storage container and the outer wall of said vessel.

* * * * *